United States Patent [19]

Greene

[11] 4,011,983

[45] Mar. 15, 1977

[54] BAG CONTAINER

[76] Inventor: William Henry Greene, 1637 Van Buren Ave., St. Paul, Minn. 55104

[22] Filed: Feb. 24, 1976

[21] Appl. No.: 660,798

[52] U.S. Cl. ..... 229/14 BE; 229/37 E

[51] Int. Cl.[2] ..... B65D 5/60

[58] Field of Search ..... 248/95, 97; 229/148, 229/14 B, 14 BE, 37 E

[56] References Cited

UNITED STATES PATENTS

| | | | |
|---|---|---|---|
| 1,284,817 | 11/1918 | Tinsley | 229/37 E |
| 1,414,236 | 4/1922 | Wamsley | 229/37 E |
| 1,713,631 | 5/1929 | Tinsley | 229/37 E X |
| 1,916,493 | 7/1933 | Solomon | 229/14 BE X |
| 3,078,026 | 2/1963 | Meimecke et al. | 229/14 B |
| 3,525,465 | 8/1970 | Hotz | 229/37 E |
| 3,662,944 | 5/1972 | Joostem | 229/14 B |

*Primary Examiner*—Davis T. Moorhead

[57] ABSTRACT

An outer container is provided of relatively strong material such as corrugated paperboard or solid fiber, or other material. This outer container is shaped to accommodate a paper grocery bag. The outer container comprises a rectangular sleeve, to a bottom wall of which is hinged a flange foldable against the wall to which it is hinged. This bottom panel is of sufficient length to engage frictionally against the opposite wall to support the bag.

1 Claim, 4 Drawing Figures

BAG CONTAINER

This invention relates to an improvement in bag container and deals particularly with a relatively rigid outer container designed to contain a grocery bag or the like, and to support the walls thereof.

BACKGROUND OF THE INVENTION

Considerable damage is caused by the breakage of bags during the delivery period between the check out counter and the vehicle. Damage is also encountered during the trip from the vehicle to the home. This damage is usually caused by the overloading of paper bags, and particularly those containing bottles of soda water, ginger ale or the like. In the past, it has been common place to hold paper bags containing heavy objects such as bottles by the bottom, and to attempt to protect the bags from breaking. Once the bags have been delivered to the customer, the store is relieved of all responsibility, and if the bags break while carrying them into the home, the purchaser is liable for this damage.

SUMMARY OF THE DISCLOSURE

I have found that bags are usually folded in a flat state with the bottom of the bag extending along one of the major walls of the bag. I have also found that by inserting a bag within a rectangular container, it can be readily opened up to fill the container, and possibly to extend over the upper edge thereof a short distance. With this arrangement the bag may be filled to its capacity with no chance of bursting the walls or bottom of the bag. In other words, the bag may be filled with heavy items such as cans, bottles, or the like and the product may be carried to the car or from the car to the house with little danger of damage.

These and other objects and features of the present invention will be further stated in the following specification and claims.

DESCRIPTION OF THE PREFERRED EMBODIMENTS

Figure 1:
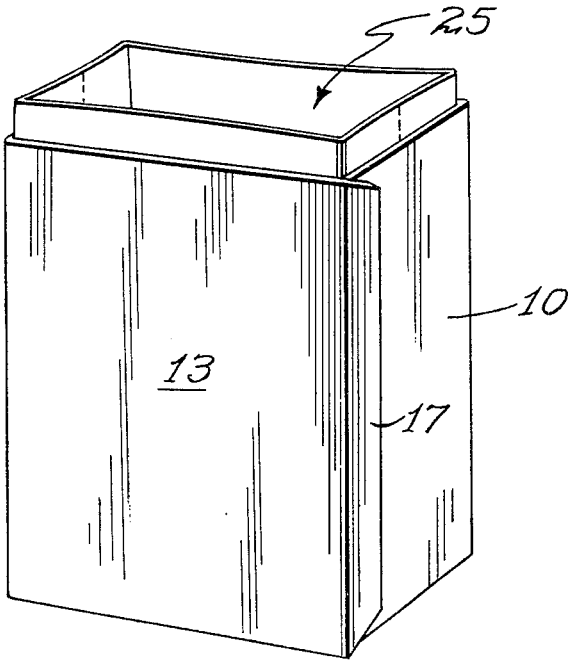
FIG. 1 is a perspective view of the complete package, before it has been closed.
Figure 2:
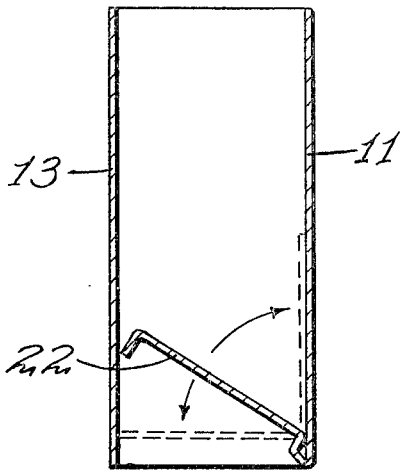
FIG. 2 is a sectional view through the outer form of the invention, showing the bottom wall in partially closed position.
Figure 4:
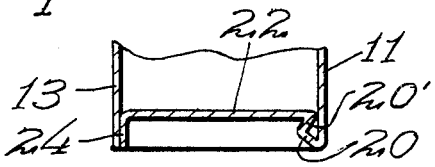
FIG. 4 is a detail sectional view of the bottom portion of the package.
Figure 3:
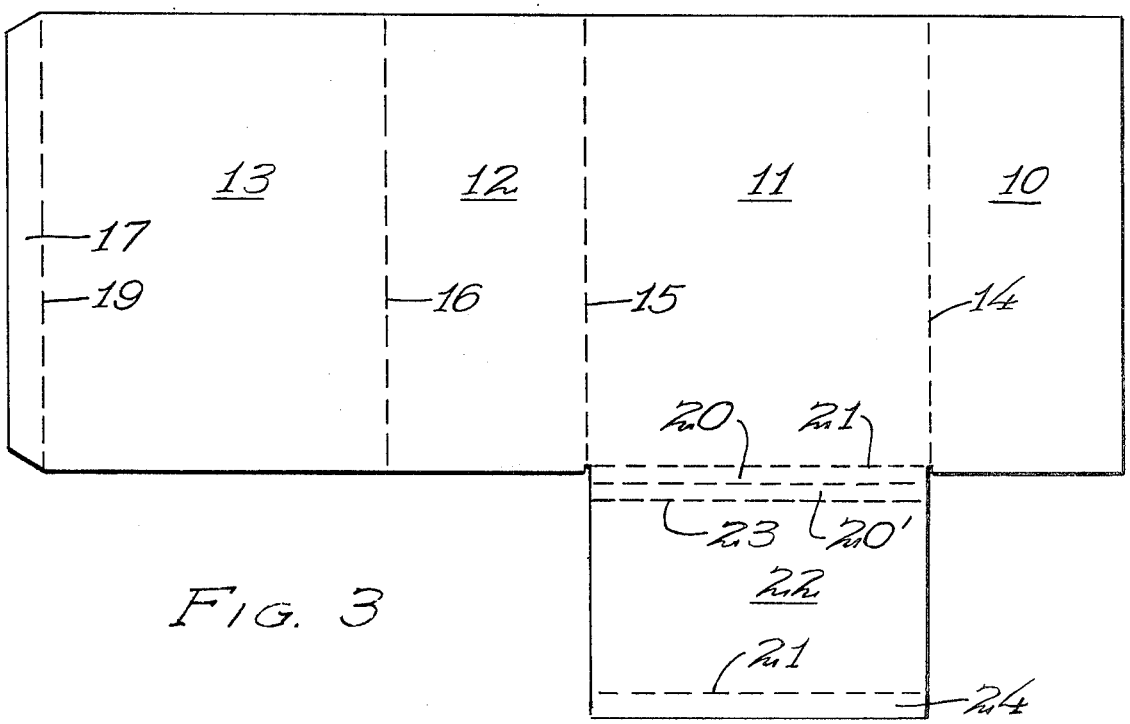
FIG. 3 is a diagrammatic view of the outer enclosure showing in general construction therof.

As indicated in FIG. 3, the outer container, which is formed of corrugated paperboard or the like includes a side panel 10, a rear panel 11, a second side panel 12, and a front panel 13 which are secured together by parallel fold lines 14, 15 and 16. A glue flap or stitch flap 17 is secured to an end panel of the series, such as the panel 13, along the fold line 19. The stitch flap or glue flap is secured in fixed relation to the other end of the series such as the wall 10, in order to connect the walls in rectangular relation.

A flange 20 is secured to the lower end of one of the major walls such as 11 along the fold line 21. A bottom panel 22 is secured to the flange 20 along the fold line 23. During the formation of the carton, the flange 20 and bottom panel 22 are folded against the major panel 11, and the flange 20 may or may not be adhesively secured to the panel 11.

In any event, the panel 22 is of slightly longer dimensions than the side wall panels 10 and 12 so that the free end 24 of the panel 22 may frictionally engage the opposite wall panel 13. As a result, the downward pivotal movement of the bottom panel is limited by engagement with the wall 13.

In previous patents, locking means have been provided for limiting the downward pivoting of the panel 22. However, the applicant has found that such locking means are unnecessary in view of the frictional engagement between the bottom panel 22 and the wall 13. In the event that economy is desired, the flap 24 may be omitted.

The bag which is indicated in general by the number 25 is a conventional grocery bag having a square bottom and rectangularly arranged side walls. The bag rests upon the bottom panel 22 which frictionally engages the wall 13. The frictional engagement seems to sufficiently overcome the weight of materials inserted into the bag 24 so that the entire unit including the outer rectangular enclosure and the bag can be thrown away and a new bag may be inserted into the outer enclosure.

It is invisioned that the super market or the like will give away the outer enclosures as well as the bags 25, in order to prevent damage to the goods contained within their premises. The bags 25 together with the outer enclosure are disposible, or may be returned for reuse if it is so desired.

In accordance with the Patent Statutes, I have described the principles of construction and operation of my Bag Container, and while I have endeavored to set forth the best embodiments, I desire to have it understood that obvious changes may be made within the scope of the following claims without departing from the spirit of my invention.

I claim:

1. In combination:

a rectangular container for a grocery bag or the like including:

rectangularly extending vertical walls foldable from a flat form to a rectangular form, a bottom panel hingedly secured to the lower edge of one of said walls and foldable to form a bottom for said container on which said grocery bag may rest, a grocery bag having a flat bottom resting upon said bottom panel and shaped to fit within rectangularly arranged vertical walls, a first flange connecting said bottom panel to the lower edge of said one of said walls, a crease intermediate the edge of said first flange connected to said bottom wall and the edge thereof connected to said bottom panel whereby said flange may flex, said bottom panel being slightly longer in a direction normal to said crease than the distance between said one wall and the opposite wall, a second flange on said bottom wall along the edge thereof connected to said flange and lying inwardly of said opposite wall, said second flange extending downwardly inwardly of said opposite wall to terminate adjacent the lower edge of said opposite wall, whereby the downward folding of said bottom panel will cause said first flange to fold along said crease.

* * * * *